United States Patent [19]

Ogura et al.

[11] 4,203,663

[45] May 20, 1980

[54] COMPUTER CONTROLLED ELECTROSTATIC COPYING MACHINE

[75] Inventors: Masaaki Ogura; Nachio Seko; Takato Yano, all of Tokyo, Japan

[73] Assignee: Ricoh Company, Ltd., Tokyo, Japan

[21] Appl. No.: 950,159

[22] Filed: Oct. 10, 1978

[30] Foreign Application Priority Data

Nov. 28, 1977 [JP] Japan ..... 52-141488

[51] Int. Cl.[2] ..... G03G 15/00

[52] U.S. Cl. ..... 355/14 C; 355/3 SH

[58] Field of Search ..... 355/14 C, 14 R, 3 R, 355/3 SH, 16

[56] References Cited

U.S. PATENT DOCUMENTS

| | | | |
|---|---|---|---|
| 3,732,005 | 5/1973 | Lloyd | 355/14 R |
| 4,099,860 | 7/1978 | Connin | 355/14 C |

*Primary Examiner*—R. L. Moses

*Attorney, Agent, or Firm*—David G. Alexander

[57] ABSTRACT

An imaging optical system (34) scans an original document (58) and radiates a light image thereof onto a photoconductive drum (31) to form an electrostatic image which is developed to form a toner image. A first pulse generator (62) is driven synchronizingly by rotation of the drum (31) to produce first pulses. A second pulse generator which may include a clock pulse generator (19) for a microcomputer (12) used to control the operation of the copying machine (11) and a frequency divider (78) produces second pulses having a frequency typically ten times that of the first pulses. First and second counters (71), (79) count the first and second pulses respectively, the second counter (79) being reset by each of the first pulses. A sensor (83) senses a predetermined scan position of the optical system (34) and generates an electrical signal. A computer which may be embodied by the microcomputer (12) in response to the signal, stores first and second counts of the first and second counters (71), (79), adds a predetermined number to the first count to obtain a third count and actuates a copy sheet feed unit (44) to feed a copy sheet (37) into toner image transferring engagement with the drum (31) when the counts in the first and second counters (71), (79) simultaneously equal the third and second counts respectively, thereby producing accurate register of the toner image on the copy sheet (37).

11 Claims, 4 Drawing Figures

COMPUTER CONTROLLED ELECTROSTATIC COPYING MACHINE

BACKGROUND OF THE INVENTION

The present invention relates to a microcomputer controlled electrostatic copying machine comprising improved means for ensuring accurate feeding of a copy sheet into toner image transferring engagement with a photoconductive drum.

Prior to the introduction of microcomputer technology, electrostatic copying machines were controlled by wired logic circuits which became quite complicated and large sized where used in high-speed, multi-mode copying machines. The circuitry became especially cumbersome where sensors were provided to monitor the ambient temperature, humidity and the like and optimally control the copying machine in response thereto in addition to controlling the basic sequence of operation.

Recently, microcomputer technology has developed to such an extent that a microcomputer comprising a central processing unit (CPU), random access memory (RAM), read-only memory (ROM) and input-output interface (I/O) can be embodied by one or more large scale integration (LSI) integrated circuit chips at quite low cost. Such microcomputers have been adapted to control electrostatic copying machines and enable elimination of a large amount of the electronic circuitry previously required.

A problem has remained heretofore unsolved in such microcomputer controlled copying machines in that the timing of feeding a copy sheet into toner image transferring engagement with a photoconductive drum has remained heretofore inaccurate. This results in the toner images being transferred out of register onto the copy sheets.

Typically, such a copying machine comprises a pulse generator which is driven synchronizingly by rotation of the drum. The pulse generator may be embodied by a disc rotatably driven by the drum formed with a series of circumferentially spaced slots therethrough. A light source and photosensor are mounted on axially opposite sides of the disc. Rotation of the disc causes the slots to alternatingly uncover the photosensor which produces electrical pulses in response thereto. The pulses are counted by the microcomputer for controlling the sequence of operation of the copying machine by means of incrementing a program counter.

A prior art method of timing the initiation or actuation of a feed roller for feeding the copy sheet into engagement with the drum comprises the step of sensing a predetermined position of a member of an optical system which scans an original document and focusses a light image thereof onto the drum. When said position is sensed, a sensor produces an electrical signal. A counter is provided to count the pulses produced by the pulse generator. In response to the signal, the counter is reset. Further rotation of the drum causes more pulses to be generated which are counted by the counter. When the count in the counter reaches a predetermined value, the feed means for the copy sheet is actuated for operation. The predetermined number corresponds to the length of time required for the toner image on the drum to reach the proper image transferring position after production of the signal.

Although this method is attractive in theory, it is inaccurate in actual operation. In order to ensure effective control of the copying machine, the pulses are generated at relatively large time intervals such as 10 ms (frequency of 100 Hz). As the scanning operation is not synchronized with the pulse generation, the sensor signal may be generated at any time between the leading edges of the pulses. This enables a maximum timing error of 10 ms to occur in the feeding of the copy sheet and allows a maximum register misalignment of $10^{-2}$ V to be produced, where V is the surface speed of the drum.

In addition to the above problem, the prior art method is not applicable to a copying machine in which an original document is fed relative to a fixed optical system for scanning. The relative register error is multiplied by the reduction ratio where reduced size copies are produced.

SUMMARY OF THE INVENTION

An electrostatic copying machine embodying the present invention comprises a rotary photoconductive member, imaging means for scanning an original document and radiating a light image thereof onto the photoconductive member to form an electrostatic image thereon and feed means for feeding a copy medium into image transferring engagement with the photoconductive member. First pulse generator means are synchronizingly driven by rotation of the photoconductive member for generating first pulses. Second pulse generator means are provided for generating second pulses having a frequency higher than the first pulses. First counter means count the first pulses and second counter means count the second pulses, the second counter means being reset by each of the first pulses. Sensing means sense movement between the imaging means and the document to a predetermined relative position and produce a signal in response thereto. Computing means store first and second counts of the first and second counter means in response to the signal, add a predetermined number to the first count to obtain a third count and actuate the feed means when the counts in the first and second counters are simultaneously equal to the third and second counts respectively.

It is an object of the present invention to provide an electrostatic copying machine comprising improved means for feeding a copy sheet into register with a toner image on a photoconductive member such as a drum or belt with greater accuracy than possible in the prior art.

It is another object of the present invention to provide copy sheet feed means for an electrostatic copying machine which can be used with an imaging means comprising a fixed optical system and document feed means.

It is another object of the present invention to provide an electrostatic copying machine which produces reduced size copies in accurate register on a copy sheet.

It is another object of the present invention to provide a generally improved electrostatic copying machine.

Other objects, together with the following, are attained in the embodiment described in the following description and shown in the accompanying drawing.

DESCRIPTION OF THE PREFERRED EMBODIMENT

While the electrostatic copying machine of the invention is susceptible of numerous physical embodiments, depending upon the environment and requirements of use, substantial numbers of the herein shown and described embodiment have been made, tested and used, and all have performed in an eminently satisfactory manner.

Figure 1:
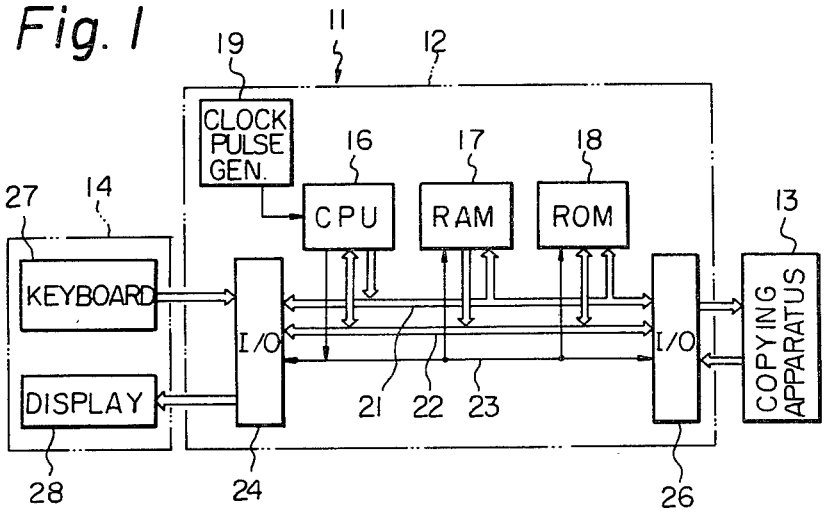
FIG. 1 is a block diagram of an electrostatic copying machine embodying the present invention.

Referring now to FIG. 1 of the drawing, an electrostatic copying machine embodying the present invention is generally designated by the reference numeral 11 and comprises a microcomputer 12 for controlling the operation of a copying apparatus 13. Further provided is a control panel 14.

The microcomputer 12 comprises a central control unit (CPU) 16, a random access memory (RAM) 17 for storing intermediate data and a read-only memory (ROM) 18 for storing the operating program of the microcomputer 12. A clock pulse generator 19 feeds system clock pulses to the CPU 16.

The microcomputer 12 is provided with an address bus 21, data bus 22 and control bus 23 by means of which it is connected to the control panel 14 and copying apparatus 13 through input-output interfaces (I/O) 24 and 26 respectively.

The control panel 14 comprises a keyboard 27. Although not shown in detail, the keyboard 27 typically comprises numerical keys for setting a number of copies to be produced, etc., into the microcomputer 12, as well as switches or keys such as a print start switch, a mode selection switch, etc. The control panel 14 further comprises a display unit 28 having light emitting diodes (LED) or the like for indicating the number of copies, a copy sheet size, a copy mode, a failure indication, etc.

Figure 2:
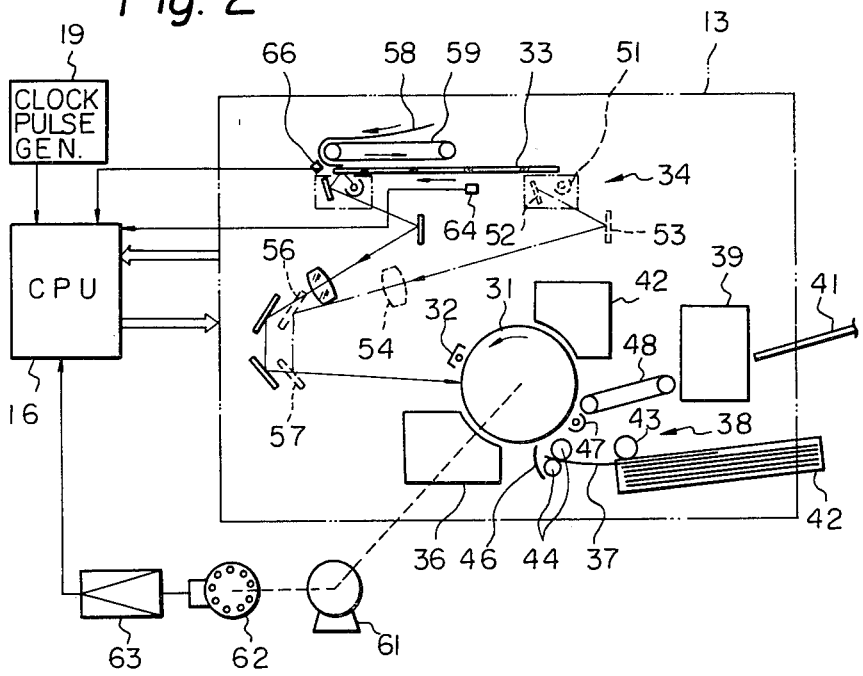
FIG. 2 is a partial schematic diagram of the present copying machine.

As shown in FIG. 2, the copying apparatus 13 comprises a photoconductive drum 31 which is rotated counterclockwise at constant speed. The drum 31 is uniformly electrostatically charged by a corona charging unit 32. A transparent platen 33 is mounted above the drum 31 for supporting an original document. An optical imaging means 34 scans the document and progressively radiates a light image thereof onto the drum 31 to form an electrostatic image. A developing unit 36 develops the electrostatic image to form a toner image which is transferred to a copy sheet 37 by a transfer unit 38. A fixing unit 39 fixes the toner image to the copy sheet 37 to form a permanent copy and discharges the copy sheet 37 into a tray 41. Then, a cleaning unit 42 cleans and discharges the drum 31.

The transfer unit 38 comprises a cassette 42 for holding the copy sheets 37 and a primary feed roller 43 for feeding the uppermost copy sheet 37 into the bite of register feed rollers 44. The rollers 44 feed the copy sheet 37 into engagement with the drum 31 at the same surface speed as the drum 31. A deflector guide 46 deflects the copy sheet 37 toward the drum 31. A corona transfer charging unit 47 applies an electrostatic charge to the back of the copy sheet 37 which causes the toner image to be transferred thereto. A conveyor belt 48 carries the copy sheet 37 from the drum 31 to the fixing unit 39.

The imaging means 34 comprises a lamp 51 for illuminating a linear portion of the document through the platen 33. A light image of the linear portion is reflected from a mirror 52 to a mirror 53 which reflects the light image through a converging lens 54 to a mirror 56. From the mirror 56 the light image is reflected via a mirror 57 to the drum 31.

The copying machine 11 is operative in two modes. The first mode is a "book mode" in which the document is placed face down on the platen 33 and maintained stationary. The lens 54 and mirrors 56 and 57 are maintained stationary in their phantom line positions. For scanning the document, the lamp 51 and mirror 52 are moved leftwardly from their phantom line positions at the same surface speed as the drum 31. The mirror 53 is also moved leftwardly but at one-half the surface speed of the drum 31.

The copying machine 11 is also operative in a "sheet mode" at unity magnification or non-unity magnification (such as a 1:2 reduction). In this mode the document, here shown and designated as 58, is inserted into an inlet (not shown) and carried over the platen 33 by a conveyor belt 59. In this case, all of the members of the imaging means 34 are maintained stationary in their illustrated solid line positions and the document 58 moved relative thereto by the conveyor belt 59.

Further illustrated is a drive motor 61 for the drum 31. Also synchronizingly driven by the motor 61 is a first pulse generator 62 of known construction. The pulse generator 62 is not shown in detail but typically comprises a disc formed with circumferential perforations or transparent areas and a light source and photosensor disposed on axially opposite sides of the peripheral portion of the disc. Rotation of the disc causes electrical pulses to be generated by the photosensor. These first pulses are amplified and squared by an amplifier 63 and applied to the CPU 16.

The manner in which the overall operation of the copying apparatus 13 is controlled by the microcomputer 12 is not the particular subject matter of the present invention and will not be described in detail. It is sufficient to understand that the first pulses from the generator 62 are counted and utilized to increment a program counter (not shown) at predetermined counts to read program steps from the ROM 18. Output signals of microswitches, photosensors, humidity sensors, etc., are fed to the CPU 16 under program control to properly actuate solenoids, motors, the lamp 51, the charging units 32 and 47, check for failure conditions and generally control the operation of the copying apparatus 13 in a sequential manner.

A microswitch 64 is actuated to produce an electric signal by the mirror 52 when the same reaches a predetermined position relative to the document on the platen 33 in the book mode. A photosensor 66 is actuated to produce an electric signal by the leading edge of the document 58 as said leading edge reaches the photosensor 66 in the sheet mode. These signals are used for the same purpose in the book and sheet modes respectively as will become clear from further description.

Figure 4:
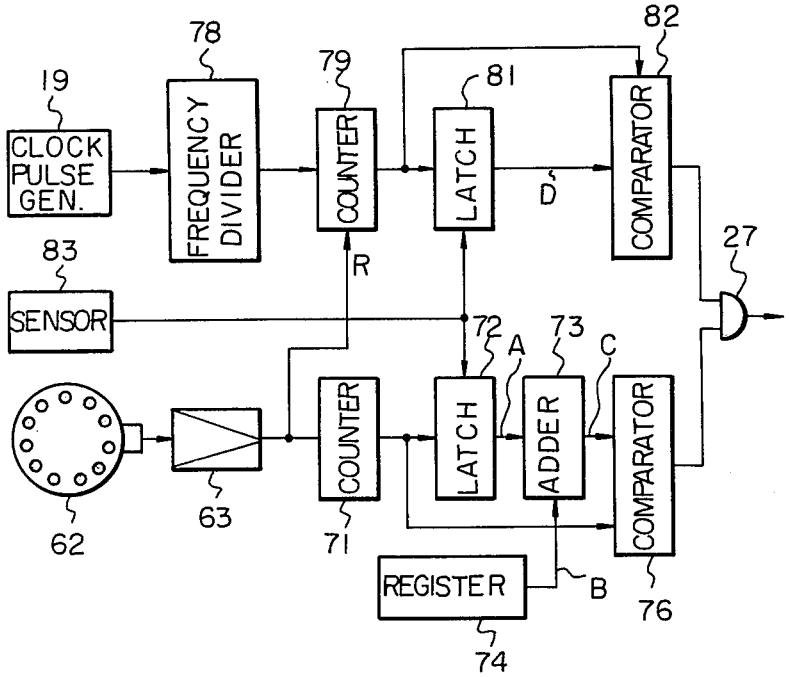
FIG. 4 is a block diagram of a computing means of the present copying machine.

The operation of feeding the copy sheet 37 in accordance with the present invention will be understood with reference being made to the block diagram of FIG. 4. Although various components are shown in discrete form in the drawing, it will be understood by those skilled in the art that such components are preferably embodied by software in the ROM 18.

The first pulses from the generator 62 are continuously counted by a first counter 71 of a suitably high modulo. The first pulses are preferably generated at a frequency of 100 Hz. The output of the counter 71 is connected to a latch 72, the output of which is connected to an input of an adder 73. The output of a register 74 which stores a predetermined number is applied to another input of the adder 73. The outputs of the counter 71 and adder 73 are applied to inputs of comparator 76, the output of which is applied to an input of an AND gate 77.

The output of the clock pulse generator 19, which is typically 1 MHz, is divided by a frequency divider 78 to 1000 Hz, or ten times the frequency of the first pulses, to constitute second pulses. The second pulses are counted by a counter 79 having a modulo of greater than ten. However, the first pulses are applied to a reset input of the counter 79 so that each first pulse resets the counter 79. In this manner, the counter 79 counts from zero to nine between each two consecutive first pulses in response to the second pulses.

The output of the counter 79 is connected to a latch 81, the output of which is connected to an input of a comparator 82. The output of the counter 79 is connected to another input of the comparator 82. The output of the comparator 82 is connected to an input of the AND gate 77. As will be understood from further description, a high output of the AND gate 77 actuates a clutch (not shown) to initiate rotation of the feed rollers 44.

In operation, a sensor 83, which is constituted by the microswitch 64 in the book mode or by the photosensor 66 in the sheet mode produces the electrical signal when actuated. This signal is applied to the latches 72 and 81 which latch the current counts in the counters 71 and 79 which will be designated as first and second counts respectively. The register 74 stores therein a predetermined constant number which is selected in accordance with the dimensions of the copying apparatus 13. More specifically, the number corresponds to the length of time for the leading edge of the toner image on the drum 31 to reach the proper position for transfer to the copy sheet 37 after generation of the signal by the sensor 83. In other words, the number corresponds to the proper length of time after generation of the electric signal for actuating the feed rollers 44 so that the copy sheet 37 will be fed into engagement with the drum 31 in perfect register with the toner image. The dimensions of the copying apparatus 13 are preferably selected so that said length of time will correspond to an integral number of the first pulses.

The adder 73 adds the predetermined number stored in the register 74 to the count in the latch 72 to obtain a third count. The first, second and third counts appear at the outputs of the latch 72, latch 81 and adder 73 and are designated as A, D and C respectively. The number stored in the register 74 is designated as B.

The comparator 76 produces a high output when the outputs of the counter 71 and adder 73 are equal, or when the count in the counter 71 is equal to the third count C. This occurs after the predetermined number B of first pulses have been generated after generation of the signal by the sensor 83. The comparator 82 produces a high output when the count in the counter 79 equals the second count D stored in the latch 81. Simultaneous high outputs of the comparators 76 and 82 cause the AND gate 77 to produce a high output and actuate the clutch to drive the feed rollers 44.

Figure 3:
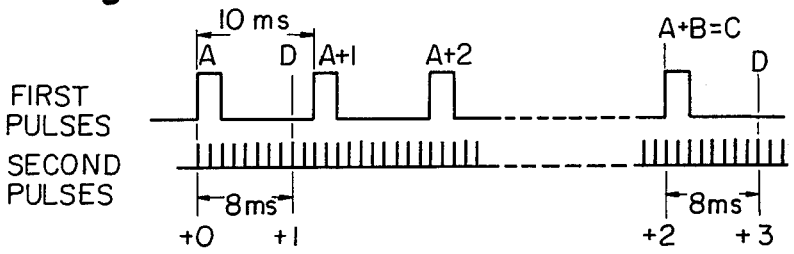
FIG. 3 is a timing diagram illustrating the operation of the present copying machine.

FIG. 3 illustrates the advantage of the present invention, and shows an exemplary case in which the signal from the sensor 83 is produced 8 ms after the counter 71 is incremented to A. More specifically, the count in the counter 71 becomes A at a time t0 which corresponds to the leading edge of the first pulse which causes the counter 71 to increment to A. However, the signal from the sensor 83 is produced at a time t1 which is 8 ms after the time t0.

The comparator 76 produces a high output at a time t2 which corresponds to the third count C in the adder 73. If this high output were to be used to actuate the feed rollers 44, as is the case in the prior art, the feed rollers 44 would be driven at the time t2 which is 8 ms earlier than the proper time for driving the feed rollers 44 which is $t3=t2+8$ ms. This would result in the toner image being out of register on the copy sheet 37.

However, in accordance with the present invention the AND gate 77 will not produce a high output at the time t2 since the output of the comparator 82 is low. This is due to the fact that the count in the counter 79 is not $b=8$, but zero. As the counter 79 is progressively incremented to D, the output of the comparator 76 remains high enabling the AND gate 77. Thus, as the count in the counter 79 becomes D and the comparator 82 produces a high output, the AND gate 77 produces a high output to actuate the feed rollers 44. The AND gate 77 produces a high output at the time t3 at which the counts in the counters 71 and 79 are simultaneously equal to the third and second counts C and D respectively. The time t3 is equal to exactly B first pulses after generation of the signal by the sensor 83. In this manner, the feed rollers 44 are actuated at exactly the right time to feed the copy sheet 37 into engagement with the drum 31 for perfect toner image transfer. It will be understood by those skilled in the art that the predetermined number B may be different in the book and sheet modes respectively to accommodate the difference in the dimensions of the apparatus 13 in the different modes.

Although the accuracy of copy sheet feed is increased as the frequency of the second pulses is increased, increasing the frequency beyond a certain practical value will cause erratic operation. Although it has been found that frequencies of the first and second pulses of 100 Hz and 1000 Hz respectively give good results in actual application, the present invention is not so limited to such frequencies. In addition, the ratio of the frequencies of the second to first pulses may be other than 10.

In summary, it will be seen that the present invention provides an electrostatic copying machine comprising improved means for ensuring accurate register of a toner image on a copy sheet. Although the present invention has been shown and described as being applied to an apparatus in which a toner image is transferred to a copy sheet, it is also applicable to an apparatus in which an electrostatic image or toner image is transferred to any type of copy medium. The present invention is especially advantageous in sheet mode copying combined with image reduction.

Various modifications will become possible for those skilled in the art after receiving the teachings of the present disclosure without departing from the scope thereof. For example, rather than using system clock pulses from the clock pulse generator 19 in conjunction with the frequency divider 78, the second pulses may be taken from any other suitable section of the microcomputer 12. For example, timing pulses for driving a multiplexed LED display in the display unit 28 may be utilized. Also, if desired, a separate pulse generator may be provided.

What is claimed is:

1. An electrostatic copying machine including a rotary photoconductive member, imaging means for scanning an original document and radiating a light image thereof onto the photoconductive member to form an electrostatic image thereon and feed means for feeding a copy medium into image transferring engagement with the photoconductive member, characterized by comprising:

first pulse generator means driven synchronizingly by rotation of the photoconductive member for generating first pulses;

second pulse generator means for generating second pulses having a frequency higher than the first pulses;

first counter means for counting the first pulses;

second counter means for counting the second pulses, the second counter means being reset by each of the first pulses;

sensing means for sensing movement between the imaging means and the document to a predetermined relative position and producing a signal in response thereto; and computing means for storing first and second counts of the first and second counter means in response to the signal, adding a predetermined number to the first count to obtain a third count and actuating the feed means when counts in the first and second counter means are simultaneously equal to the third and second counts respectively.

2. A copying machine as in claim 1, in which a ratio of the frequency of the second pulses to the frequency of the first pulses is 10:1.

3. A copying machine as in claim 1, in which the feed means comprises a feed roller.

4. A copying machine as in claim 1, in which the computing means comprises a microcomputer, the second pulse generator means comprising a clock pulse generator means comprising a clock pulse generator for producing clock pulses for the microcomputer.

5. A copying machine as in claim 1, in which the imaging means comprises optical means for focussing a light image of the document onto the photoconductive member.

6. A copying machine as in claim 5, in which the optical means is held stationary, the imaging means further comprising document feed means for moving the document relative to the optical means.

7. A copying machine as in claim 6, in which the sensing means is constructed to sense a leading edge of the document.

8. A copying machine as in claim 7, in which the sensing means comprises a photosensor.

9. A copying machine as in claim 5, in which the document is held stationary, the imaging means being moved relative to the document.

10. A copying machine as in claim 9, in which the sensor means is constructed to sense a member of the optical means.

11. A copying machine as in claim 10, in which the sensor means comprises a switch which is actuated by said member of the optical means.

* * * * *